US010256088B2

(12) United States Patent
Baba

(10) Patent No.: US 10,256,088 B2
(45) Date of Patent: Apr. 9, 2019

(54) DEVICE FOR ION SORTING BY M/Z

(71) Applicant: DH Technologies Development Pte. Ltd., Singapore (SG)

(72) Inventor: Takashi Baba, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 60 days.

(21) Appl. No.: 15/531,505

(22) PCT Filed: Oct. 14, 2015

(86) PCT No.: PCT/IB2015/057880
§ 371 (c)(1),
(2) Date: May 30, 2017

(87) PCT Pub. No.: WO2016/087961
PCT Pub. Date: Jun. 9, 2016

(65) Prior Publication Data

US 2017/0263431 A1 Sep. 14, 2017

Related U.S. Application Data

(60) Provisional application No. 62/088,483, filed on Dec. 5, 2014.

(51) Int. Cl.
*H01J 49/00* (2006.01)
*H01J 49/42* (2006.01)

(52) U.S. Cl.
CPC ..... *H01J 49/4225* (2013.01); *H01J 49/4205* (2013.01); *H01J 49/4255* (2013.01)

(58) Field of Classification Search
CPC . H01J 49/4225; H01J 49/4205; H01J 49/4255
USPC ..... 250/281, 282, 283, 290, 293
See application file for complete search history.

(56) References Cited

U.S. PATENT DOCUMENTS

2006/0284080 A1 12/2006 Makarov et al.
2009/0140140 A1 6/2009 Raznikov et al.
2009/0194684 A1 8/2009 Guna et al.
(Continued)

OTHER PUBLICATIONS

International Search Report and Written Opinion for PCT/IB2015/057880, dated Apr. 29, 2016.

*Primary Examiner* — Michael Maskell
(74) *Attorney, Agent, or Firm* — John R. Kasha; Kelly L. Kasha; Kasha Law LLC

(57) ABSTRACT

An RF voltage is applied across each electrode of a first array of evenly spaced, parallel, and coplanar electrodes and its corresponding electrode of a second array of evenly spaced, parallel, and coplanar electrodes. The RF voltage varies in amplitude according to an RF voltage amplitude gradient. The RF voltage produces an array of different quadrupole RF electric fields in a uniform gap between the first array and the second array. A DC voltage is superimposed on each electrode of the first array and its corresponding electrode of the second array. The DC voltage varies according to a DC voltage gradient in order to produce a DC electric field in the uniform gap. When ions are introduced in the uniform gap, the DC electric field causes the ions to drift toward quadrupole RF electric fields with increasing RF voltage amplitudes where the ions are trapped according to their m/z.

13 Claims, 14 Drawing Sheets

(56) References Cited

U.S. PATENT DOCUMENTS

| | | | | |
|---|---|---|---|---|
| 2009/0294655 | A1* | 12/2009 | Ding | H01J 49/004 250/283 |
| 2011/0186724 | A1* | 8/2011 | Nolting | H01J 49/0072 250/282 |
| 2011/0186728 | A1* | 8/2011 | Franzen | H01J 49/062 250/282 |
| 2013/0009051 | A1* | 1/2013 | Park | H01J 49/063 250/282 |

* cited by examiner

100

200

400

500

600

700

800

900

1000

DEVICE FOR ION SORTING BY M/Z

CROSS REFERENCE TO RELATED APPLICATION

This application claims the benefit of U.S. Provisional Patent Application Ser. No. 62/088,483, filed Dec. 5, 2014, the content of which is incorporated by reference herein in its entirety.

INTRODUCTION

The sample ions generated in ion sources in mass spectrometers are composed of many kinds of ions, including the targeted ions for analysis and also chemical noise ions. In order to apply mass analysis, targeted ions are selected solely (i.e., using isolation) or roughly (i.e., using wide band isolation or data independent acquisition (DIA) methods, such as ABSciex's MS/MS$^{ALL}$ acquisition method or ABSciex's SWATH™).

Widely used devices for isolation are quadrupole (Q) filters and ion traps. Q filters are the most widely used devices for isolation, but ions with mass-to-charge ratio (m/z) values outside of the isolation window are lost so that the duty cycle of sample consumption is low (~1/(number of targeting species)).

Mass selective extraction using ion traps can improve the duty cycle. After all ions are trapped, a part of the trapped ions are mass selectively extracted for further analysis. The duty cycle is given by ~(injection duration)/(total duration), and it can be high, but it cannot reach 100%, because the extraction time for each of the ions is not negligible. This multiplexing idea using an ion trap can offer efficient multiple target precursor accumulation. However, the following mass analysis requires time for each precursor ion. As a result, the duty cycle is decreased considerably for an ion trap mass analyzer.

Using more than one mass analyzer has been proposed to help solve this problem. However, the various precursor ions must be multiplexed or sorted into the multiple mass analyzers. There are many ways to sort ions into multiple mass analyzers. For example, ions can be sorted by time, m/z, ion mobility in a gas, charge state, and mass.

Ions can be sorted by time in liquid chromatography mass spectrometry (LC-MS) analysis, for example. This is accomplished by pre trapping the next analyte during the previous MS analysis.

Ions can be sorted by ion mobility in a gas using a device such as the device described in U.S. Pat. No. 8,581,177 (hereinafter the "'177 patent"), for example. The device of the '177 patent includes two planar arrays of radio frequency (RF) rod electrodes. The two planar arrays are placed in proximity so that RF rod electrodes of the each array are in parallel. The gap between the two arrays is made to be larger than the inter-rod separation in each array so that direct current (DC) and RF potentials applied to the RF rod electrodes of the arrays form axial channels for containing the targeted ions. The gap between the two arrays is filled with a gas (e.g., Helium, Neon, Argon) at pressures ranging from about 20 mTorr to 0.1 Torr.

Ions are sorted by first introducing the targeted ions with different m/z values of a mass range into a first axial channel. Then a desired DC electric field gradient is applied of about 1 V/cm up to about 10 V/cm by predetermined voltages (e.g., via DC pulses from about 1 μsec up to 10 μsec to selected RF rod electrodes. The applied DC field gradients and beneficial pressures enable ion mobility physics to apply to the ion transport (e.g., in a time frame of less than about 200 μsec) and separation of the ions, resulting in the movement of ions from the first axial channel to one or more adjacent axial channels. When separation is completed, ions are locked into their axial channels by raising the DC potentials at selected RF rod electrodes in a predetermined fashion. Finally, the separated ions are ejected axially using DC potentials.

Although the device of the '177 patent provides a high duty cycle, a need exists for systems and methods of ion sorting in mass spectrometry that provide a 100% duty cycle and can sort ions into multiple m/z ranges that are not dependent on ion mobility.

SUMMARY

A system is disclosed for sorting ions by mass-to-charge ratio (m/z) values. The system includes a first array of N evenly spaced, parallel, and coplanar electrodes, a second array of N evenly spaced, parallel, and coplanar electrodes, a radio frequency (RF) voltage source and circuit, and a direct current (DC) voltage source and circuit.

The first array and the second array are aligned so that there is a uniform gap between them. They are also aligned so that each electrode of the first array is aligned with a corresponding electrode of the second array in a plane that is perpendicular to the plane of the first array.

The RF voltage source and circuit apply an RF voltage across each electrode of the first array and its corresponding electrode of the second array. The RF voltage varies in amplitude with each succeeding electrode of the first array according to an RF voltage amplitude gradient. The RF voltage also changes phase by 180 degrees with each succeeding electrode of the first array in order to produce an array of N−1 different quadrupole RF electric fields in the uniform gap.

The DC voltage source and circuit superimpose a DC voltage on each electrode of the first array and its corresponding electrode of the second array. The DC voltage varies in voltage with each succeeding electrode of the first array according to a DC voltage gradient in order to produce a DC electric field in the uniform gap. When ions of an ion beam of a mass spectrometer are introduced in the uniform gap near a quadrupole RF electric field with a lower RF voltage amplitude, the DC electric field causes the ions to drift toward quadrupole RF electric fields with increasing RF voltage amplitudes where the ions are trapped according to their m/z values.

A method is disclosed for sorting ions by m/z values. An RF voltage is applied across each electrode of a first array of N evenly spaced, parallel, and coplanar electrodes and its corresponding electrode of a second array of N evenly spaced, parallel, and coplanar electrodes. The RF voltage varies in amplitude with each succeeding electrode of the first array according to an RF voltage amplitude gradient. The RF voltage also changes phase by 180 degrees with each succeeding electrode of the first array in order to produce an array of N−1 different quadrupole RF electric fields in a uniform gap between the first array and the second array. The first array and the second array are aligned so that each electrode of the first array is aligned with a corresponding electrode of the second array in a plane that is perpendicular to the plane of the first array.

A DC voltage is superimposed on each electrode of the first array and its corresponding electrode of the second array. The DC voltage that varies in voltage with each succeeding electrode of the first array according to a DC voltage gradient in order to produce a DC electric field in the uniform gap. When ions of an ion beam of a mass spectrometer are introduced in the uniform gap near a quadrupole RF electric field with a lower RF voltage amplitude, the DC electric field causes the ions to drift toward quadrupole RF electric fields with increasing RF voltage amplitudes where the ions are trapped according to their m/z values.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
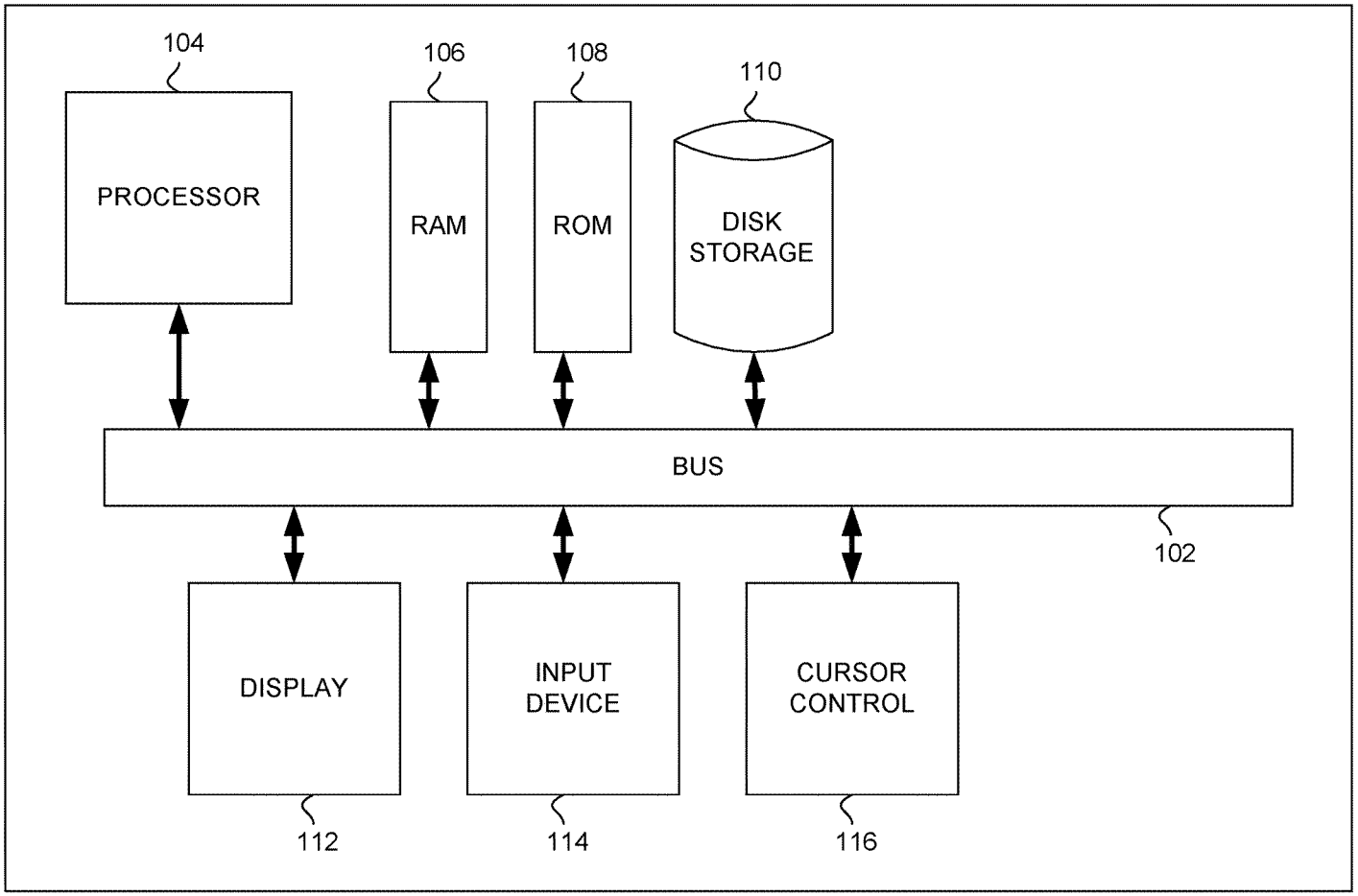
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

In various embodiments, computer system 100 can be connected to one or more other computer systems, like computer system 100, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods for Ion Sorting by M/Z

As described above, using more than one mass analyzer has been proposed to help improve the duty cycle of mass spectrometers. However, the various precursor ions must be multiplexed or sorted into the multiple mass analyzers. There are many ways to sort ions into multiple mass analyzers. For example, ions can be sorted by time, mass-to-charge ratio (m/z), ion mobility in a gas, charge state, and mass.

Although a device designed to sort ions by ion mobility in a gas has been shown to provide a high duty cycle, a need exists for systems and methods of ion sorting in mass spectrometry that provide a 100% duty cycle and can sort ions into multiple m/z ranges that are not dependent on ion mobility.

In various embodiments, systems and method are provided to sort ions by m/z values and increase the duty cycle of a mass spectrometer to 100% or close to 100%.

Electrodes

In various embodiments, electrodes for an m/z sorting device are composed of two planar arrays of electrodes separated by a gap. The electrodes of the each array are arranged in parallel. This arrangement produces a series of parallel quadrupoles. In various embodiments, the electrodes of the two planar arrays are metal rods. In various alternative embodiments, the electrodes of the two planar arrays are metal layers on two separate printed circuit boards (PCBs).

Figure 2:
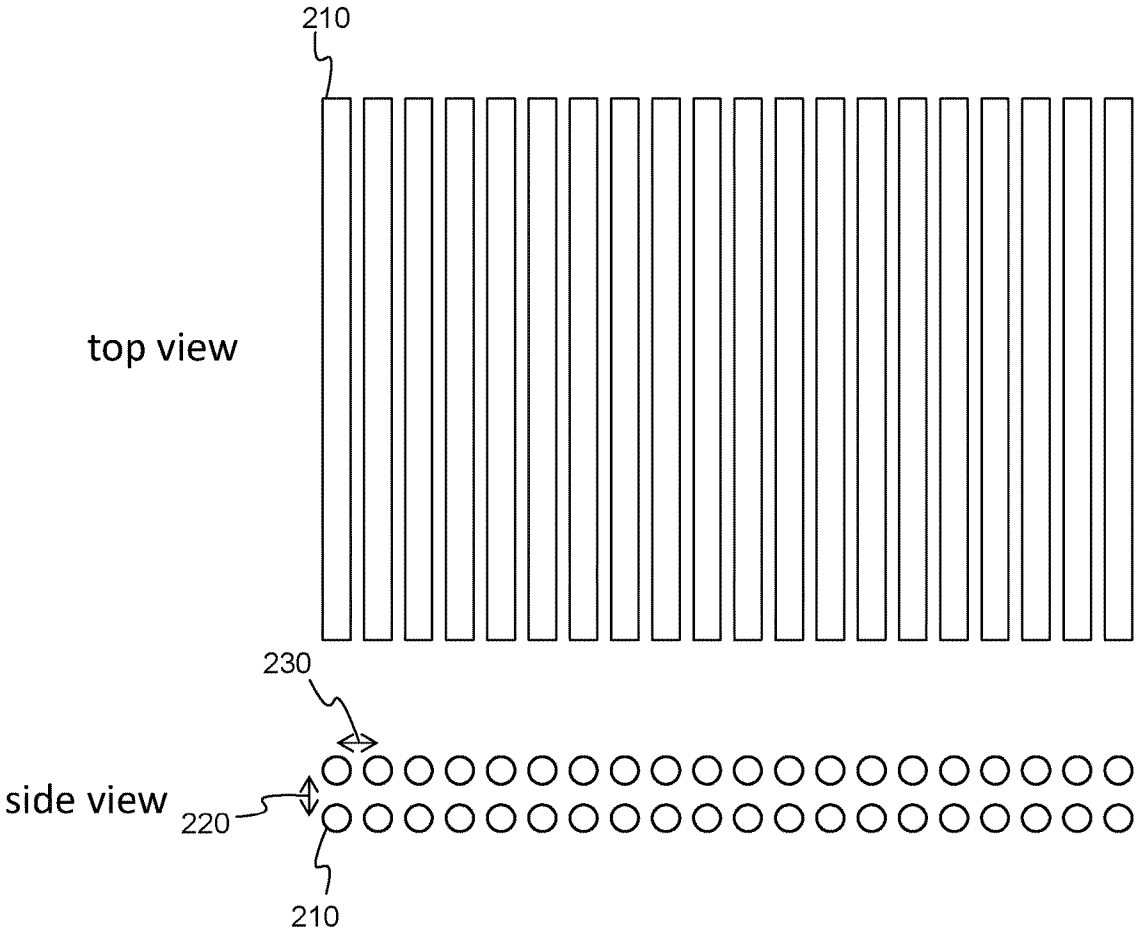
FIG. 2 is a schematic diagram showing top and side views of two planar arrays of metal rod electrodes used in a mass-to-charge ratio (m/z) sorting device, in accordance with various embodiments.

FIG. 2 is a schematic diagram 200 showing top and side views of two planar arrays of metal rod electrodes used in an m/z sorting device, in accordance with various embodiments. The distance 220 between the two planar arrays and the distance 230 between rod electrodes 210 in each planar array are the same distance. This distance is, for example, 5 mm to 10 mm. Each group of four rod electrodes 210 constructs a quadrupole.

Figure 3:
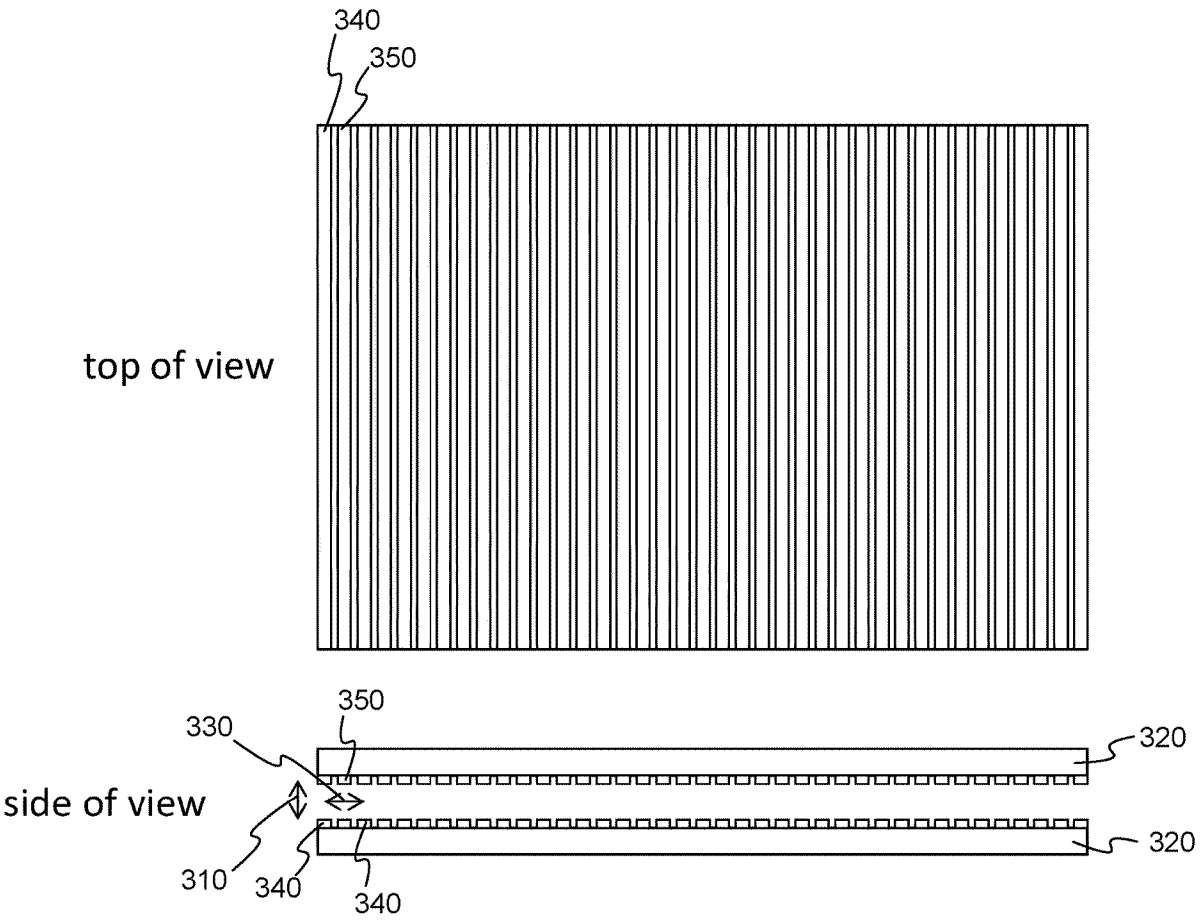
FIG. 3 is a schematic diagram showing top and side views of two parallel arrays of coplanar metal layers on two separate printed circuit boards (PCBs) used in an m/z sorting device, in accordance with various embodiments.

FIG. 3 is a schematic diagram 300 showing top and side views of two parallel arrays of coplanar metal layers on two separate PCBs used in an m/z sorting device, in accordance with various embodiments. The distance 310 between two separate PCBs 320 and the distance 330 between metal layers 340 on the two separate PCBs 320 are the same distance. Metal layers 340 receive radio frequency (RF) and direct current (DC) voltages to make each group of four metal layers 340 act as a quadrupole. However, the planar configuration of metal layers 340 exposes PCBs 320 to the impacts from ions.

As a result, in various embodiments metal layers 350 between metal layers 340 are added and given only a DC voltage. Consequently, each group of four metal layers 340 and two metal layers 350 act as a quadrupole. The m/z sorting device of FIG. 3 is easier and cheaper to construct than the m/z sorting device of FIG. 2.

Electronics

Figure 4:
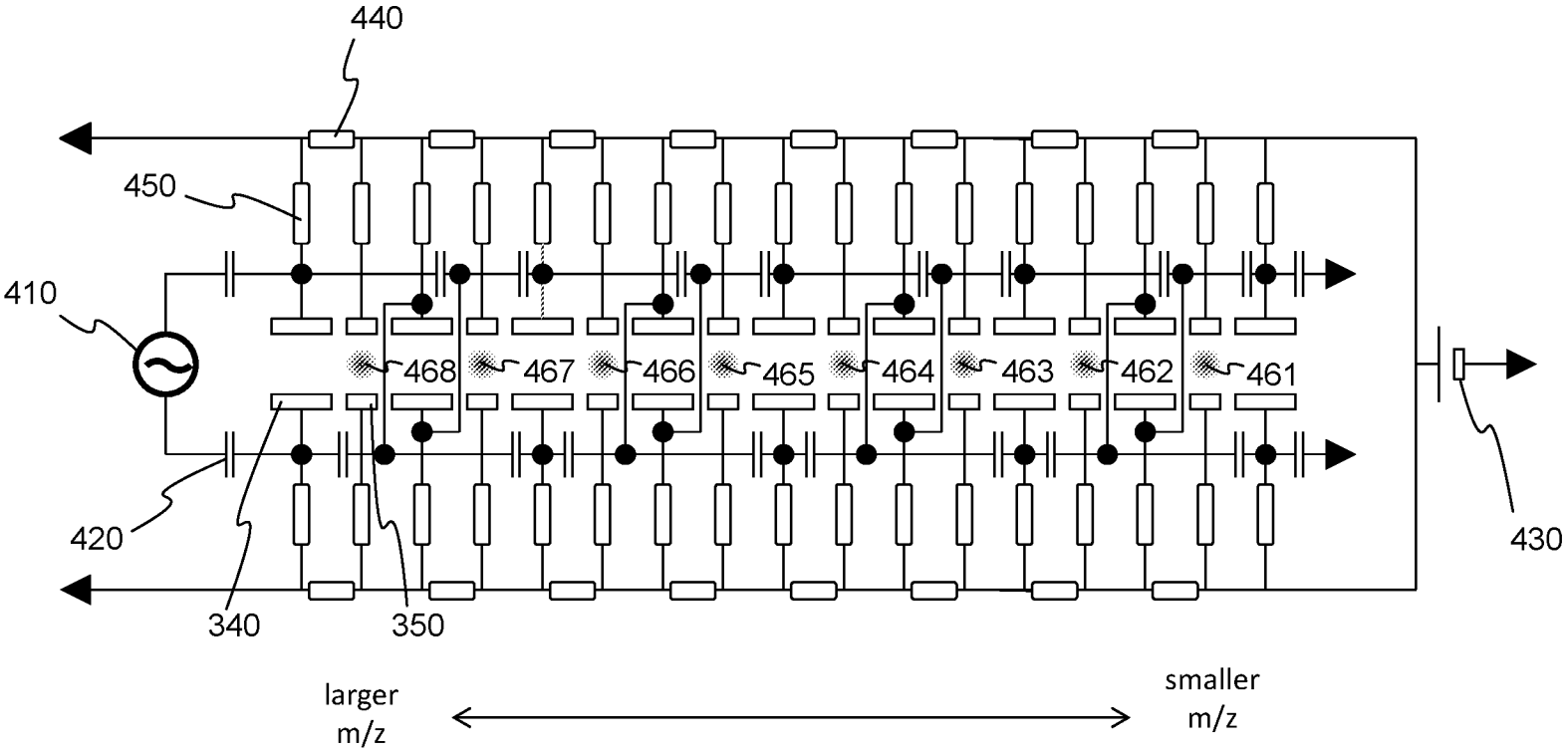
FIG. 4 is a circuit diagram showing the voltages applied to two parallel arrays of coplanar metal layers on two separate PCBs used in an m/z sorting device, in accordance with various embodiments.

FIG. 4 is a circuit diagram 400 showing the voltages applied to two parallel arrays of coplanar metal layers on two separate PCBs used in an m/z sorting device, in accordance with various embodiments. An RF voltage and a DC voltage are applied to the electrodes 340. The RF voltage is generated, for example, by a sine wave generator 410, an RF amplifier (not shown), and an LC tank circuit (not shown). The RF voltage is applied to one end of the PCB electrode array. The RF voltage is divided to make a quadrupole field array between the PCBs. The amplitude of the RF voltage is divided by capacitors 420, for example. The RF voltage amplitude on the left hand side of FIG. 4 is higher (more specific, ion ejection side) than the amplitude in the right hand side (more specific, ion injection side). The dividing capacitors 420 have the same capacitance, so the RF voltage amplitude applied to the metal layers 340 are constantly decreasing from the left side to the right side. The frequency of the RF voltage is, for example, 100 kHz-10 MHz and a typical value is 1 MHz. The amplitude of the RF voltage is between 100V and 1000V, for example.

In addition to the RF voltage, DC voltage is applied to metal layers 340 using DC voltage source 430. In the case of ions that are positively charged, the DC voltage on the right hand side of FIG. 4 is higher than the DC voltage on the left hand side. In the case of negative ions, the DC voltage should be inverted, i.e., the DC voltage on the right hand side is lower than the DC voltage on the left hand side. Using resistors 440, the DC voltage is divided and applied to metal layers 340. Using the same resistance of the resistors 440, a nearly constant gradient of dc electric field is created between the two PCBs. To superimpose the DC field on the RF field, resistors 450 with a large resistance (>100 k ohm) are connected between the metal layers 340 and the resistor 440 ladders.

In various embodiments, RF and DC voltages are applied to two planar arrays of metal rod electrodes used in an m/z sorting device. Essentially, metal layers 340 are replaced by metal rod electrodes as shown in FIG. 2.

Returning to FIG. 4, in various embodiments, metal layers 350 are introduced between metal layers 340 to prevent ions from penetrating the PCBs. Metal layers 350 are also given a DC voltage according the DC voltage gradient provided by DC voltage source 430, resistors 440, and resistors 450.

The RF and DC voltages applied to metal layers 340 produce ion channels 461-468. In the case of positive ions, for example, the voltage gradients of the RF voltage and the DC voltage are opposite. The unsorted ions are injected along channel 461, for example, on the lower RF side. The metal layers 340 and 350 are immersed in a gas container with cooling gas. The gas is, for example, helium or nitrogen. The pressure of the gas is between 1 mTorr and 1 Torr, for example. For the best sorting selection, the pressure is set as high as possible. If the pressure is too high, however, extraction of the sorted ions will be too slow to obtain a reasonable time resolution for the mass spectrometer. Due to the applied RF voltages, applied DC voltages, and the cooling gas, ions move to ion channels 461-468 based on their different m/z values. Ions with larger m/z values move to channels on the left hand side of FIG. 4, for example.

Principle

In various embodiments, an m/z sorting device includes a ladder RF field with an amplitude gradient, a ladder DC field with the voltage gradient, and a cooling gas. In the case of positive ions, the direction of the DC voltage gradient is opposite to the direction of the RF voltage amplitude gradient. In the case of negative ions, the DC voltage gradient has the same direction as the RF voltage amplitude gradient.

The ladder RF field makes an array of pseudo potential minimums between the PCBs or the rod electrodes of the m/z sorting device, and the depth of the pseudo potential is aligned from shallower to deeper. The DC voltage slope is superimposed on the pseudo potential array.

Because the pseudo potential has an m/z dependence, the shape of the total potential is varied by m/z of the ions. For small m/z ions, the pseudo potential is deeper and for larger m/z ions, the pseudo potential is shallower.

Unsorted positive ions are injected at the low RF voltage amplitude and high DC voltage side of the m/z device. The ions then move toward the lower DC potential side from the injection point. If the ions are cooled enough by the cooling gas, the drift motion of the ions is stopped at the first potential minimum, and the ions are trapped in the potential minimum. For smaller m/z ions, the first potential minimum appears at a position or quadrupole with a higher DC voltage. For larger m/z ions, the first potential minimum appears at a position or quadrupole with a lower DC voltage. As a result, multiple of ions with different m/z values are simultaneously sorted in an m/z range and trapped in one of the quadrupoles within the array of parallel quadrupoles.

If the ions are not cooled enough by the cooling gas, the drifting ions may jump across the first potential barrier and the sorting mass range may not be as sharp (low resolution).

Figure 5:
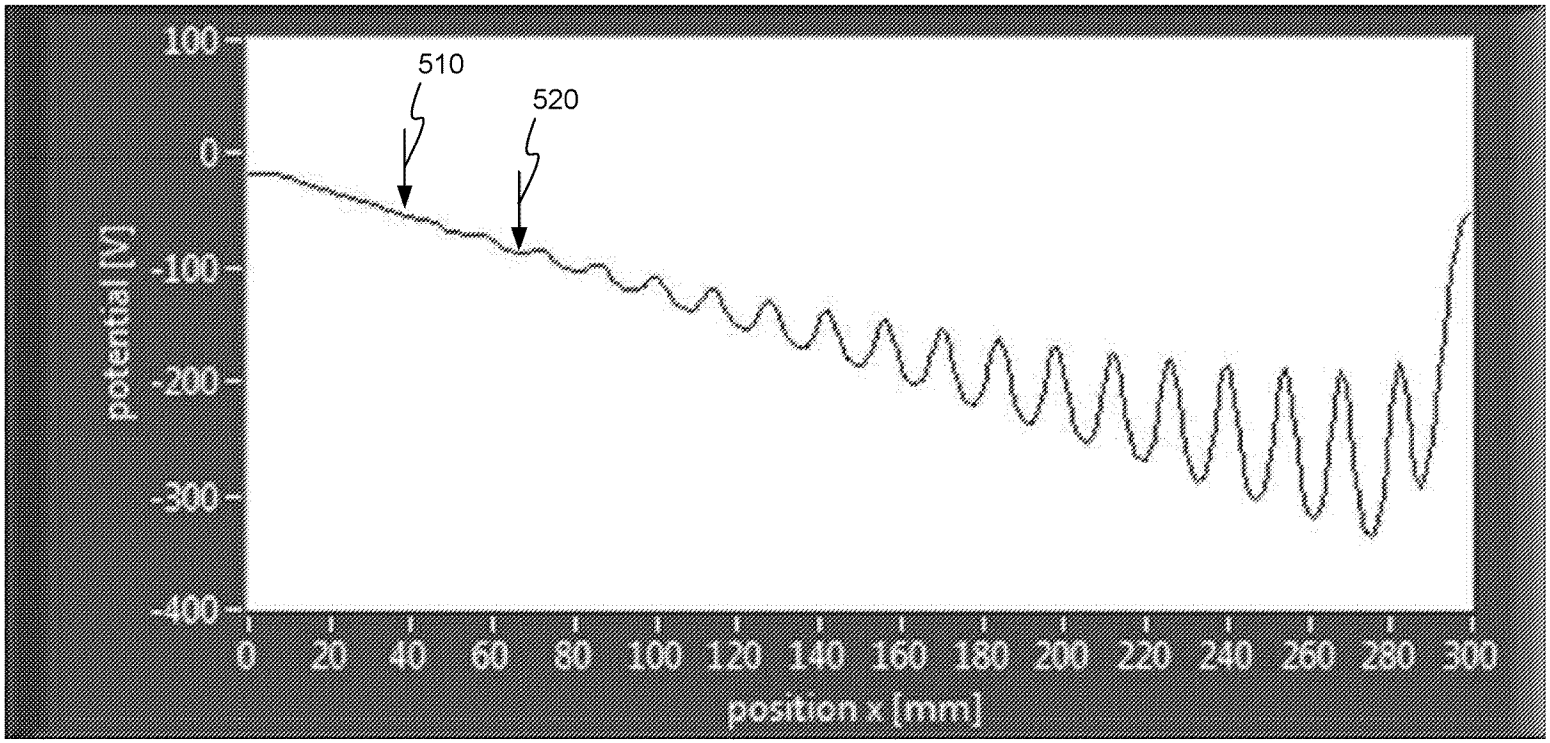
FIG. 5 is an exemplary plot of the calculated voltage potential with respect to position observed by an ion with an m/z of 300 in an m/z sorting device that includes an array of parallel quadrupoles formed from two parallel arrays of coplanar electrodes separated by a gap, in accordance with various embodiments.

FIG. 5 is an exemplary plot 500 of the calculated voltage potential with respect to position observed by an ion with an m/z of 300 in an m/z sorting device that includes an array of parallel quadrupoles formed from two parallel arrays of coplanar electrodes separated by a gap, in accordance with various embodiments. Unsorted ions are injected at position 510. Ions with an m/z of 300 move to position 520, which is the first potential minimum with a lower DC voltage.

Figure 6:
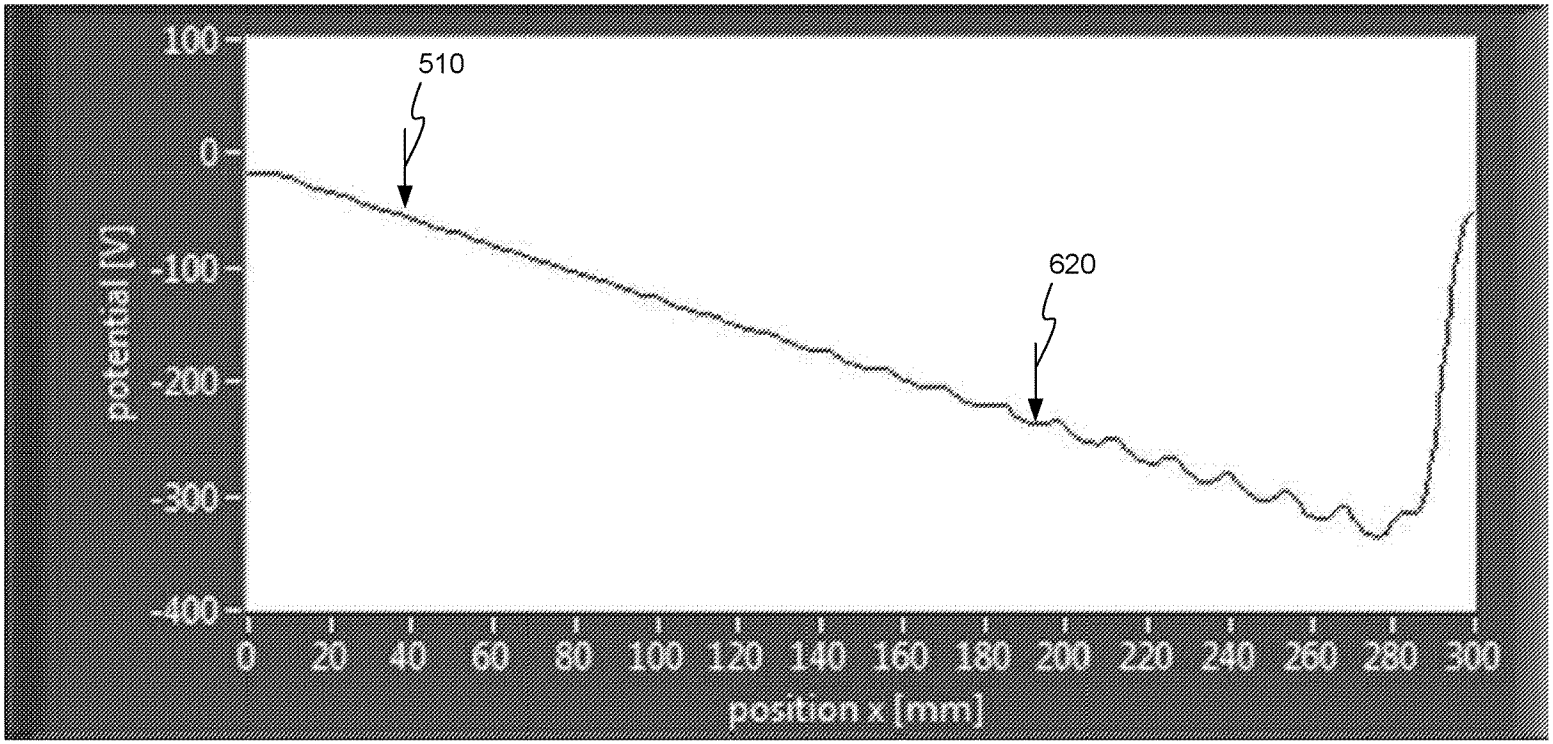
FIG. 6 is an exemplary plot of the calculated voltage potential with respect to position observed by an ion with an m/z of 2000 in an m/z sorting device that includes an array of parallel quadrupoles formed from two parallel arrays of coplanar electrodes separated by a gap, in accordance with various embodiments.

FIG. 6 is an exemplary plot 600 of the calculated voltage potential with respect to position observed by an ion with an m/z of 2000 in an m/z sorting device that includes an array of parallel quadrupoles formed from two parallel arrays of coplanar electrodes separated by a gap, in accordance with various embodiments. Unsorted ions are injected at position 510. Ions with an m/z of 2000 move to position 620, which is the first potential minimum with a lower DC voltage.

Figure 7:
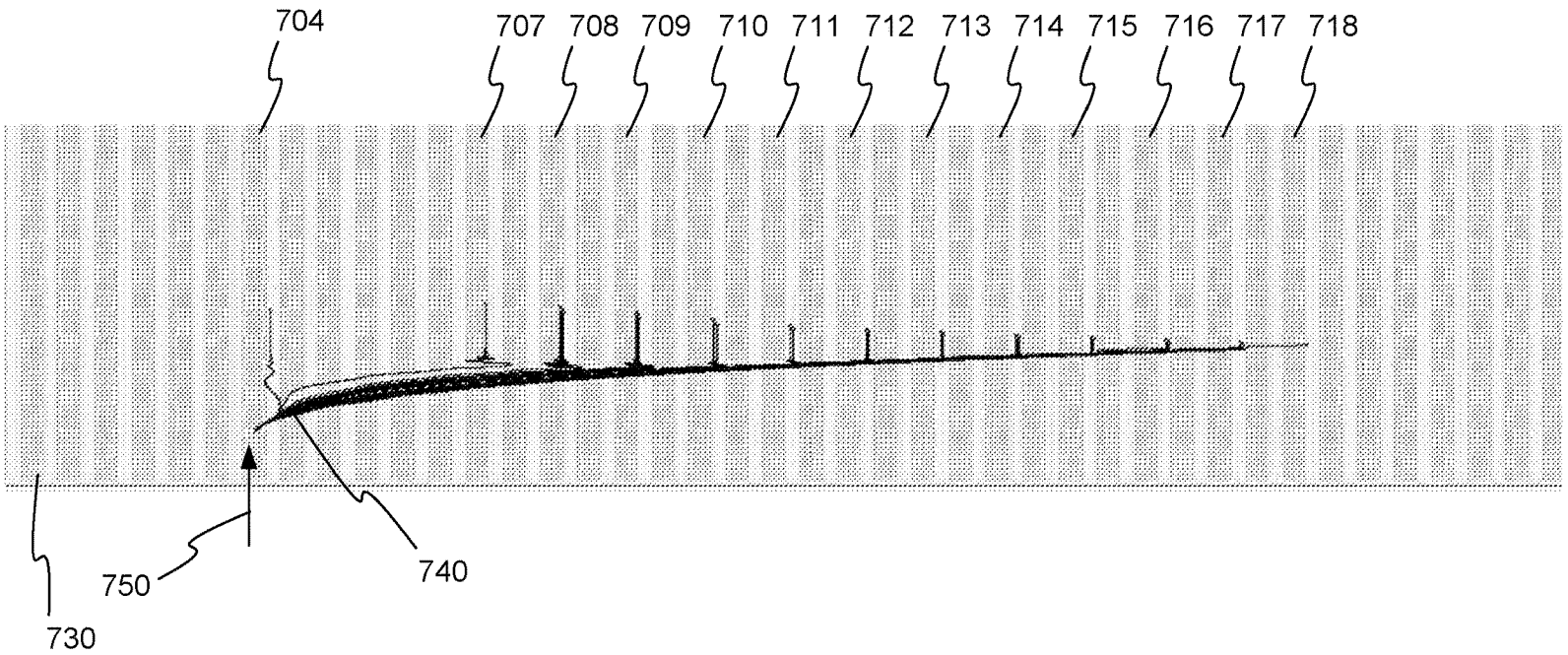
FIG. 7 is a schematic diagram of a simulation of ion motion superimposed on the lower array of coplanar electrodes of an m/z sorting device that includes two parallel arrays of coplanar electrodes separated by a gap, in accordance with various embodiments.

FIG. 7 is a schematic diagram 700 of a simulation of ion motion superimposed on the lower array of coplanar electrodes of an m/z sorting device that includes two parallel arrays of coplanar electrodes separated by a gap, in accordance with various embodiments. Lower array of coplanar electrodes 730 are metal layers of a PCB, for example. As described above, for the metal layers of PCBs, a metal layer can be placed between to the quadrupole metal layers and biased with only a DC voltage in order to prevent ions from hitting the PCBs. As a result, in each coplanar array, a group of three metal layers produces an m/z channel. Therefore, in FIG. 7 each group of three coplanar electrodes 730 represents a channel.

Ions 740 enter the m/z sorting device at position 750 of channel 704. The RF and DC voltages applied to the two parallel arrays of coplanar electrodes and the cooling gas introduced in the gap between the two parallel arrays of coplanar electrodes cause ions 740 to move and be sorted by m/z into channels 707-718.

Figure 8:
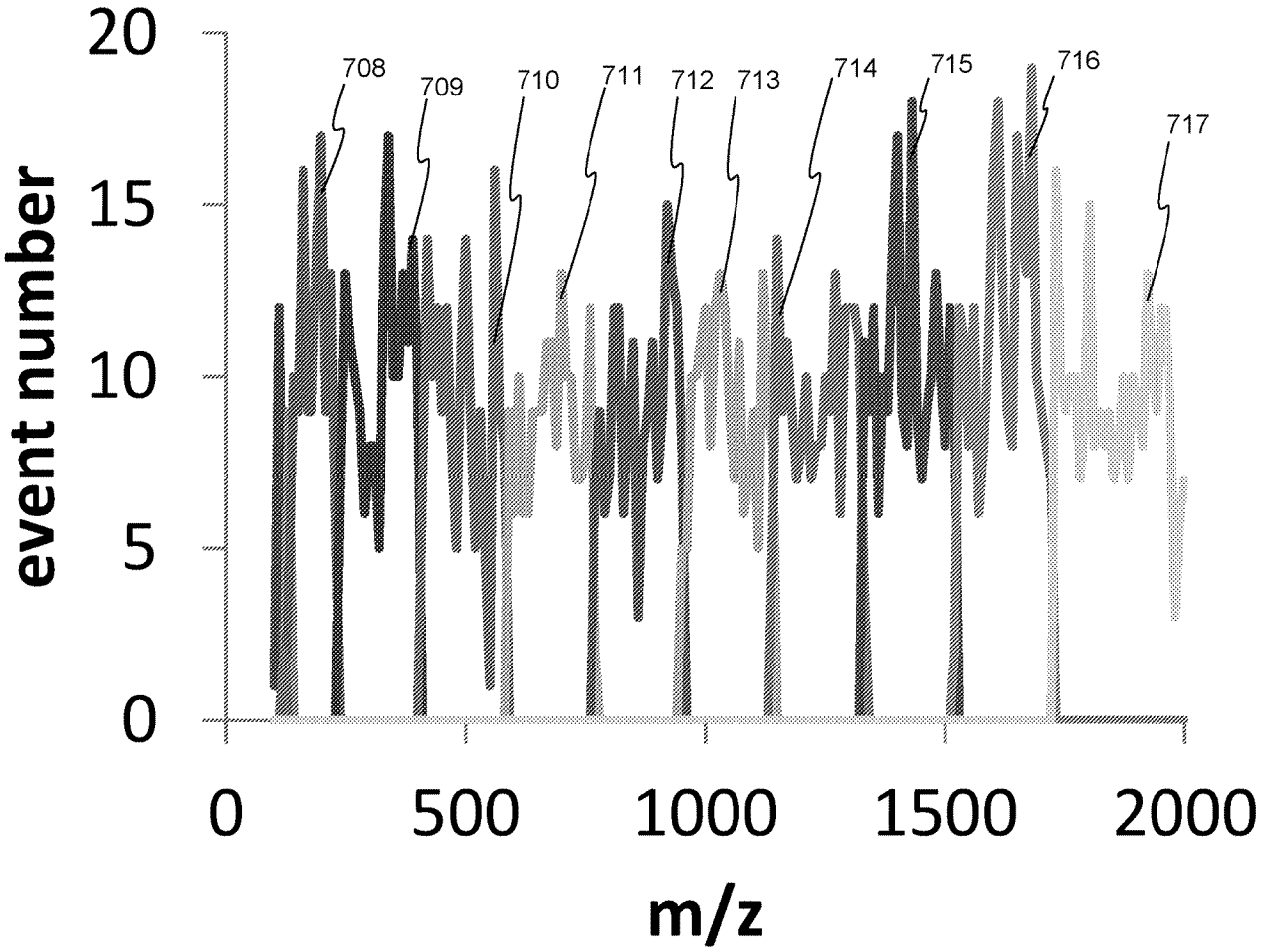
FIG. 8 is a plot of the combination of plots of ion events versus m/z for each of channels 708-717 of the ion simulation of FIG. 7, in accordance with various embodiments.

FIG. 8 is a plot 800 of the combination of plots of ion events versus m/z for each of channels 708-717 of the ion simulation of FIG. 7, in accordance with various embodiments. The width of the m/z band in each channel is approximately 200. Plot 800 shows that the ions are sorted with sharp boundaries.

Operation

In various embodiments, an m/z sorting device that includes two parallel arrays of coplanar electrodes separated by a gap is a flow through device. In other words, the m/z sorting device includes one input for receiving unsorted ions and two or more outputs for sending sorted ions to other stages of mass spectrometers.

Figure 9:
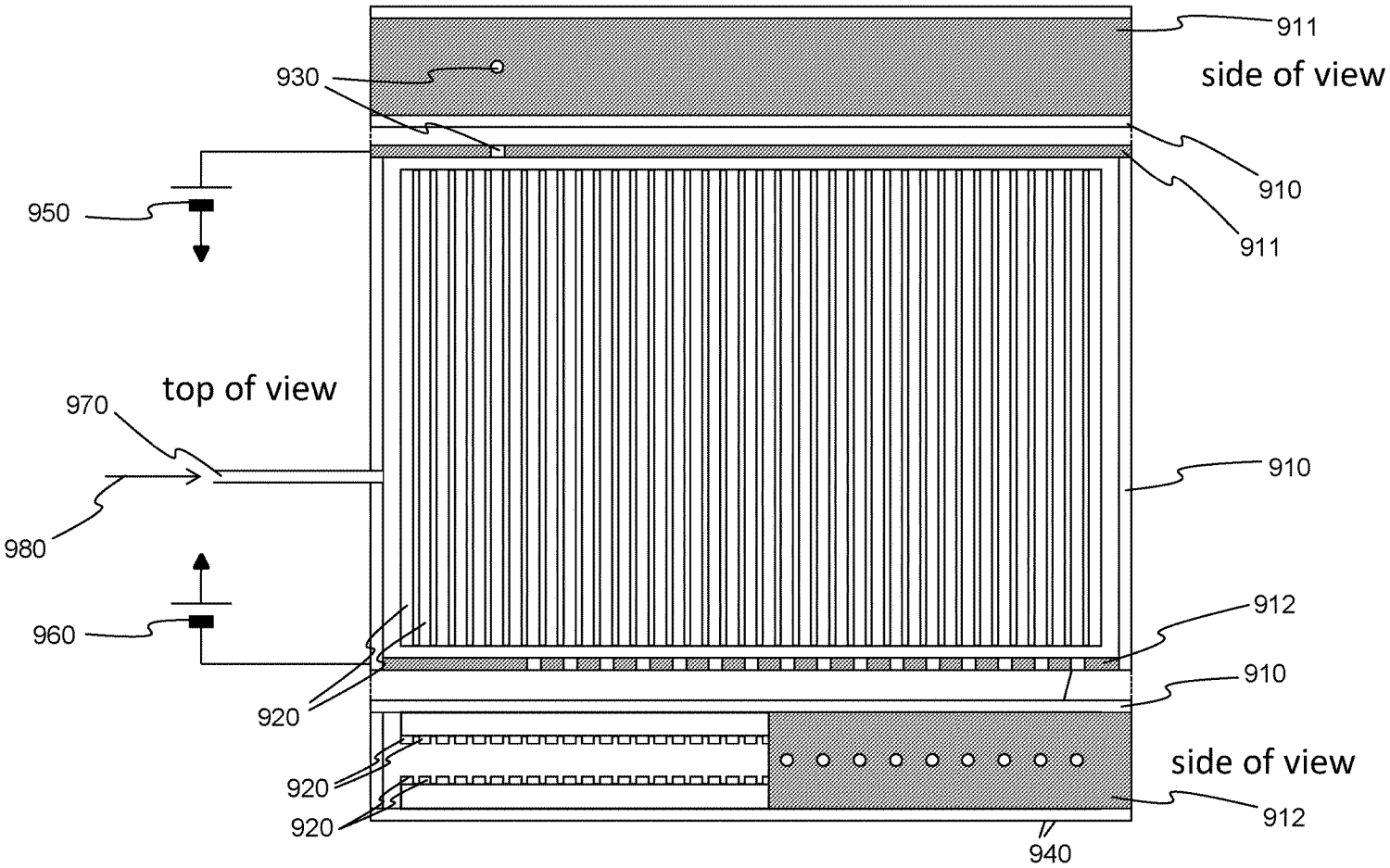
FIG. 9 is a schematic diagram showing a top and two side views of a flow through m/z sorting device that includes two parallel arrays of coplanar metal layers on two separate PCBs, in accordance with various embodiments.

FIG. 9 is a schematic diagram 900 showing a top and two side views of a flow through m/z sorting device that includes two parallel arrays of coplanar metal layers on two separate PCBs, in accordance with various embodiments. The m/z sorting device is contained in enclosure 910. Enclosure 910 includes wall electrodes 911 and 912. Wall electrodes 911 and 912 are positioned near the edges of metal layers 920.

Wall electrode 911 has ion inlet hole 930. An ion source (not shown) can be connected to ion inlet hole 930. Wall electrode 912 has multiple exit holes 940. Multiple exit holes 940 are located at each RF potential minimum location. For flow through operations, for example, wall electrode 911 is biased positively, using DC voltage source 950, with respect to the maximum DC bias applied to metal layers 920, and wall electrode 912 is biased negatively, using DC voltage source 960, with respect to the minimum DC bias applied to metal layers 920. Ions obtained using wall electrode 911, sorted into m/z mass ranges using metal layers 920, and then extracted using wall electrode 912. Multiple mass analyzers, such as Q filters, can be placed at multiple exit holes 940, for example.

Enclosure 910 also includes gas inlet 970. Gas inlet 970 is used to receive a cooling gas 980.

Figure 10:
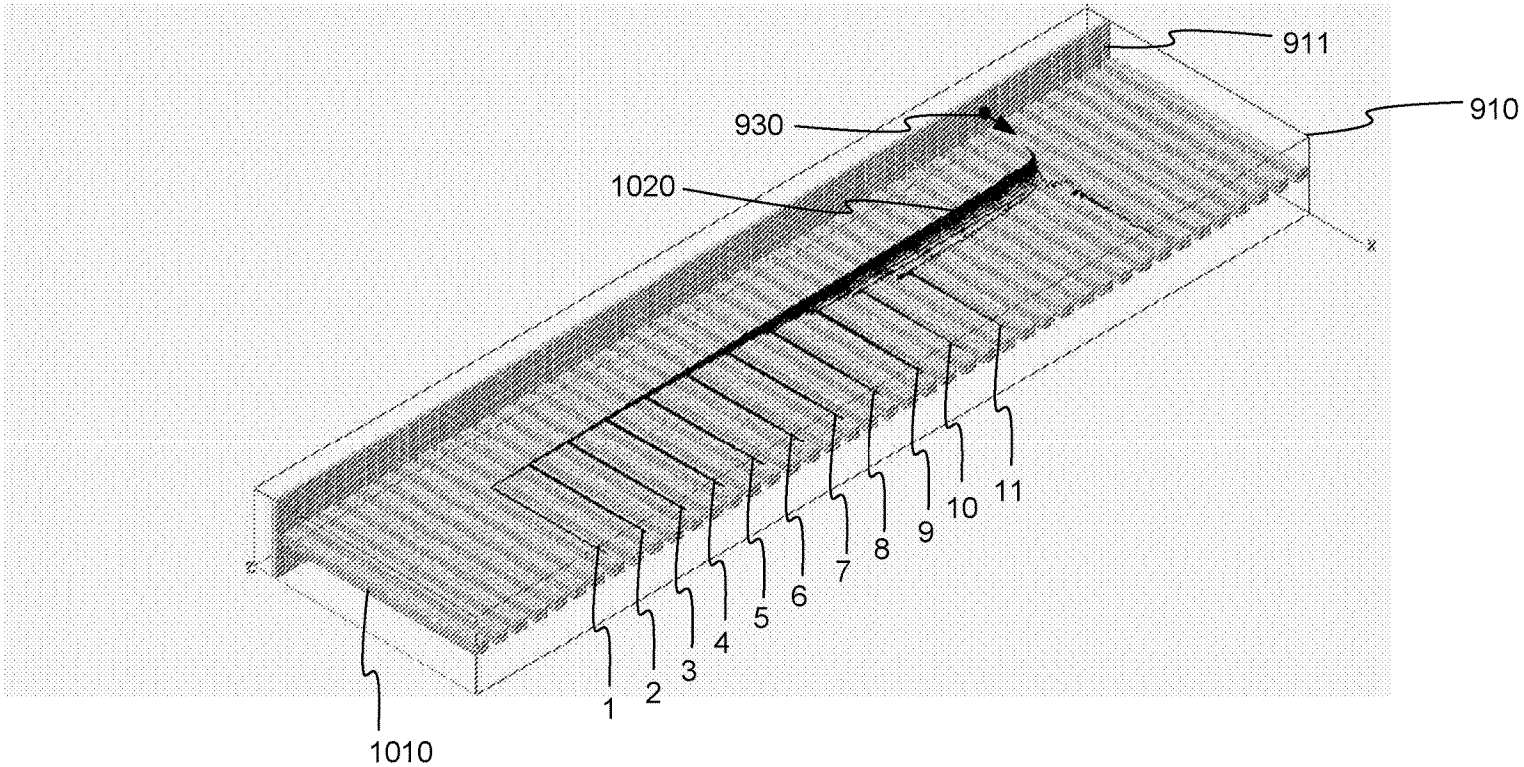
FIG. 10 is a schematic diagram of a simulation of ion motion superimposed on the lower array of coplanar electrodes of a flow through m/z sorting device that includes two parallel arrays of coplanar electrodes separated by a gap, in accordance with various embodiments.

FIG. 10 is a schematic diagram 1000 of a simulation of ion motion superimposed on the lower array of coplanar electrodes 1010 of a flow through m/z sorting device that includes two parallel arrays of coplanar electrodes separated by a gap, in accordance with various embodiments. Ions 1020 enter enclosure 910 through ion inlet hole 930 of wall electrode 911. The RF and DC voltages applied to the two parallel arrays of coplanar electrodes and the cooling gas introduced in the gap between the two parallel arrays of coplanar electrodes cause ions 1020 to move and be sorted by m/z into channels 1-11. Ions in channels 1-11 are then ejected through exit holes (not shown) in enclosure 910.

In various embodiments, an m/z sorting device that includes two parallel arrays of coplanar electrodes separated by a gap is a trapping device. In other words, the m/z sorting device includes one input for receiving unsorted ions and one output for sending sorted ions to other stages of a mass spectrometer. The sorted ions are sent to other stages of the mass spectrometer sequentially, for example.

Figure 11:
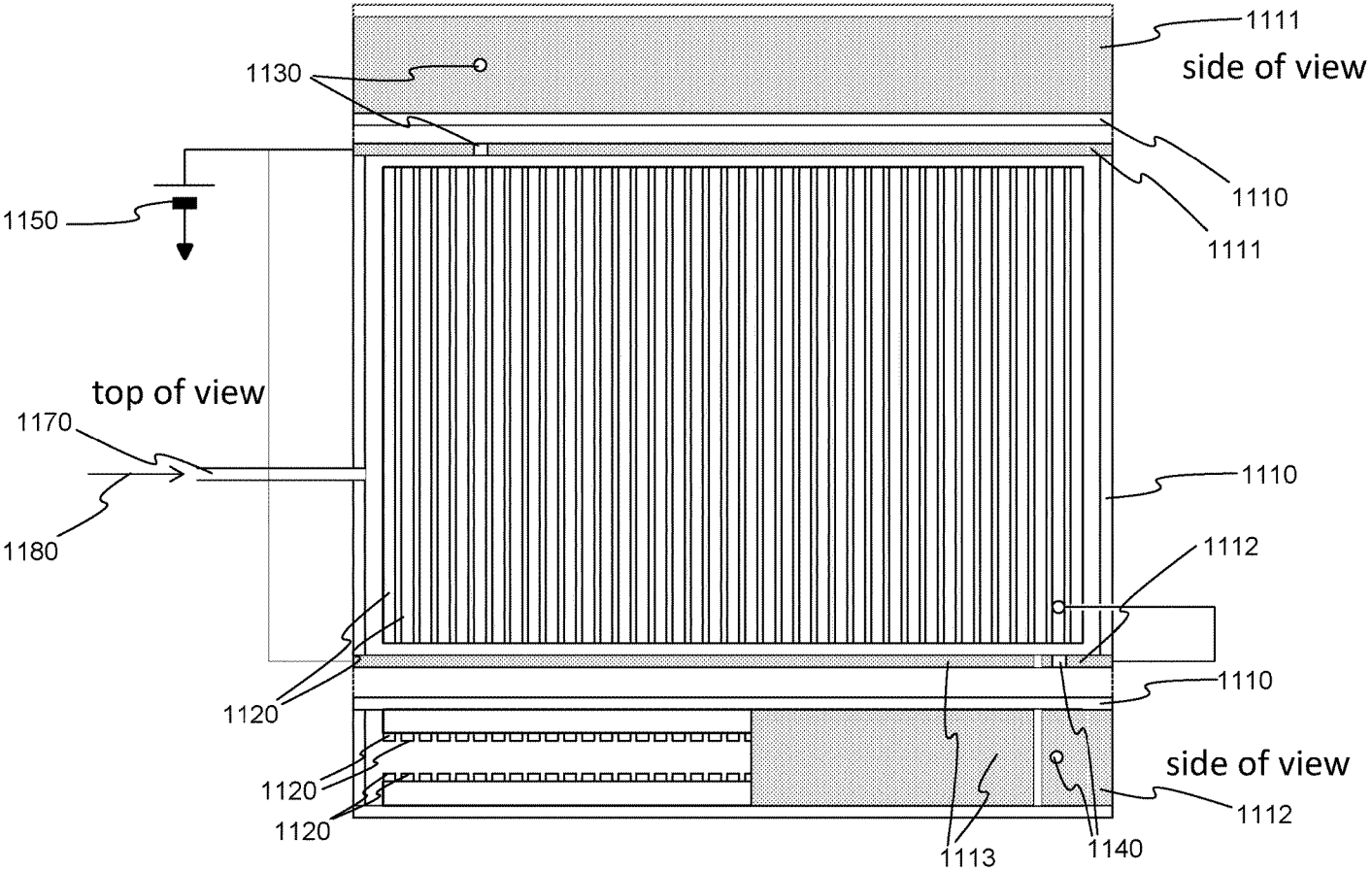
FIG. 11 is a schematic diagram showing a top and two side views of a trapping m/z sorting device that includes two parallel arrays of coplanar metal layers on two separate PCBs, in accordance with various embodiments.

FIG. 11 is a schematic diagram 1100 showing a top and two side views of a trapping m/z sorting device that includes two parallel arrays of coplanar metal layers on two separate PCBs, in accordance with various embodiments. The m/z sorting device is contained in enclosure 1110. Enclosure 1110 includes wall electrodes 1111, 1112 and 1113. Wall electrodes 1111, 1112, and 1113 are positioned near the edges of metal layers 1120.

Wall electrode 1111 has ion inlet hole 1130. An ion source (not shown) can be connected to ion inlet hole 1130. For trapping operations, for example, wall electrode 1111 and 1113 are biased positively, using DC voltage source 1150, with respect to the maximum DC bias applied to metal layers 1120. Wall electrode 1112 has one exit hole 1140. Wall electrode 1112 is biased with the same DC voltage as the final metal layer of metal layers 1120.

The sorted ions are trapped in each channel of the trapping m/z sorting device. When the RF voltage amplitude of metal layers 1120 is swept to lower value, the potential minimum for a specific ion is shifting to a lower DC potential, effectively shifting ions from one channel to another. When ions reach the last channel, they are extracted though exit hole 1140, because there is no potential barrier between wall electrode 1112 and metal layers 1120. A single mass spectrometer such as a TOF mass analyzer, an ion trap mass analyzer, or a Q filter, for example, can receive ions from exit hole 1140 for mass analysis.

Enclosure 1110 also includes gas inlet 1170. Gas inlet 1170 is used to receive a cooling gas 1180.

Figure 12:
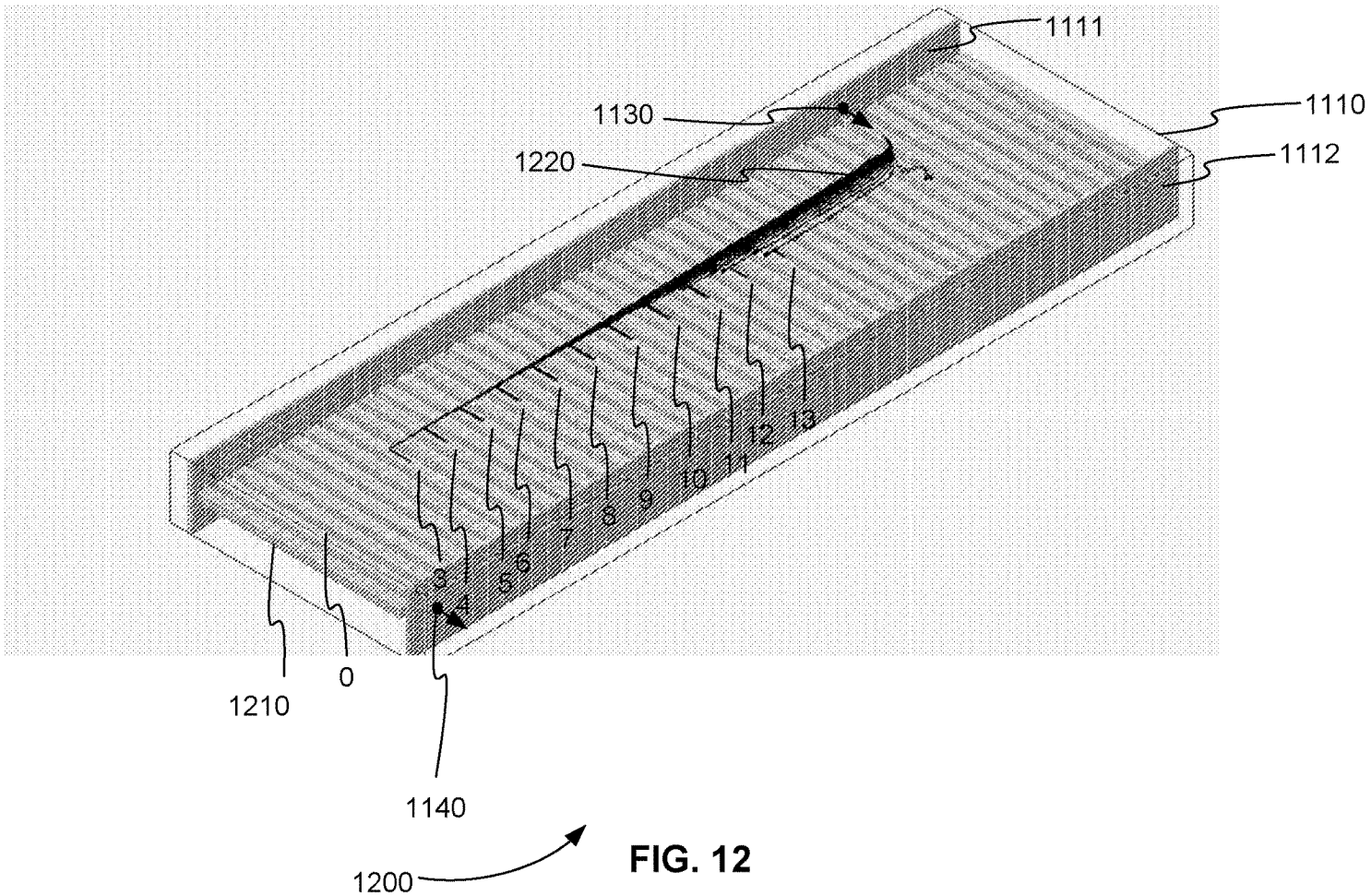
FIG. 12 is a schematic diagram of a simulation of ion motion superimposed on the lower array of coplanar electrodes of a trapping m/z sorting device that includes two parallel arrays of coplanar electrodes separated by a gap, in accordance with various embodiments.

FIG. 12 is a schematic diagram 1200 of a simulation of ion motion superimposed on the lower array of coplanar electrodes 1210 of a trapping m/z sorting device that includes two parallel arrays of coplanar electrodes separated by a gap, in accordance with various embodiments. Ions 1220 enter enclosure 1110 through ion inlet hole 1130 of wall electrode 1111. The RF and DC voltages applied to the two parallel arrays of coplanar electrodes and the cooling gas introduced in the gap between the two parallel arrays of coplanar electrodes cause ions 1220 to move and be sorted by m/z into channels 3-13. Once trapped, the ions in channels 1-11 are shifted to neighboring channels by sweeping the RF voltage amplitude of metal layers 1120 to lower values. Eventually, the ions of channel 3 are shifted to all the way to channel 0 and ejected through exit hole 1140 in wall electrode 1112. In the next sweep of the RF voltage amplitude of metal layers 1120 the ions of the next channel are shifted to channel 0 and ejected through exit hole 1140 in wall electrode 1112. This process continues until all trapped ions are sequentially shifted to channel 0 and ejected through exit hole 1140 in wall electrode 1112.

System for Sorting Ions by m/z Values

Figure 13:
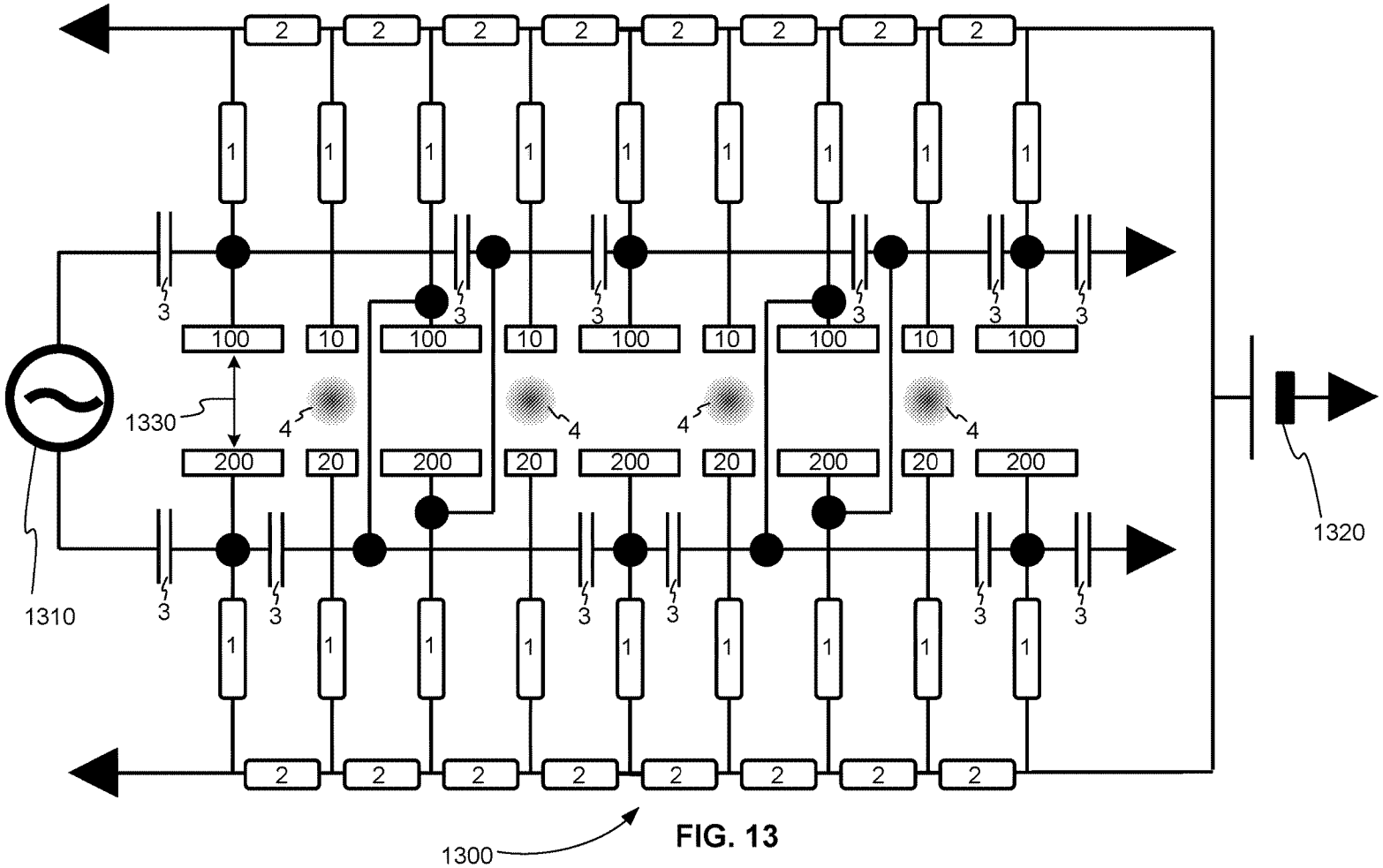
FIG. 13 is a circuit diagram of a system for sorting ions by m/z values, in accordance with various embodiments.

FIG. 13 is a circuit diagram 1300 of a system for sorting ions by m/z values, in accordance with various embodiments. The system includes a first array of N evenly spaced, parallel, and coplanar electrodes 100, a second array of N evenly spaced, parallel, and coplanar electrodes 200, an RF voltage source 1310, an RF circuit, a DC voltage source 1320, and a DC circuit. In FIG. 13, the number of electrodes (N) is 5, for example.

Electrodes 100 of the first array and electrodes 200 of the second array are aligned so that there is a uniform gap 1330 between the first array and the second array. Electrodes 100 of the first array and electrodes 200 of the second array are also aligned so that each electrode 100 is aligned with a corresponding electrode 200 of the second array in a plane that is perpendicular to the plane of the first array.

RF voltage source 1310 and the RF circuit apply an RF voltage across each electrode 100 of the first array and its corresponding electrode 200 of the second array. The RF circuit includes capacitors 3, for example. The RF voltage varies in amplitude with each succeeding electrode 100 of the first array according to an RF voltage amplitude gradient and changes phase by 180 degrees with each succeeding electrode 100 of the first array in order to produce an array of N−1 different quadrupole RF electric fields 4 in uniform gap 1330. In FIG. 13, the number of different quadrupole RF electric fields (N−1) is 4, for example. Note that although FIG. 13 shows that an RF voltage that varies in amplitude with each succeeding electrode 100 of the first array according to an RF voltage amplitude gradient is produced with a single RF voltage source 1310 and an RF circuit, various embodiments of the present invention are not limited to this configuration. For example, N different RF voltage sources can be used to apply a different an RF voltage with a different amplitude across each electrode 100 of the first array and its corresponding electrode 200 of the second array.

DC voltage source 1320 and a DC circuit superimpose a DC voltage on each electrode 100 of the first array and its corresponding electrode 200 of the second array. The DC voltage varies with each succeeding electrode 100 of the first array according to a DC voltage gradient in order to produce a DC electric field in the uniform gap. The DC circuit includes resistors 1 and 2, for example.

When ions of an ion beam of a mass spectrometer are introduced in uniform gap 1330 near a quadrupole RF electric field 4 with a lower RF voltage amplitude, the DC electric field causes the ions to drift toward quadrupole RF electric fields 4 with increasing RF voltage amplitudes where the ions are trapped according to their m/z values.

In various embodiments, and as shown in FIG. 13, for positive ions, the RF voltage amplitude gradient and the DC voltage gradient have opposite directions. In other words, for positive ions, the RF voltage amplitude decreases from the left hand side of FIG. 13 to the right hand side and the DC voltage increases from the left hand side of FIG. 13 to the right hand side.

In various alternative embodiments and for negative ions, the RF voltage amplitude gradient and the DC voltage gradient have the same direction. In other words, for negative ions, the RF voltage amplitude decreases from the left hand side of FIG. 13 to the right hand side and the DC voltage also decreases from the left hand side of FIG. 13 to the right hand side. Note that the polarity of DC voltage source 1320 is reversed.

In various embodiments, the N electrodes 100 of the first array and the N electrodes 200 of the second array are metal rods.

In various embodiments, the N electrodes 100 of the first array are N metal layers 200 of a first PCB (not shown) and the electrodes 200 of the second array are N metal layers 200 of a second PCB (not shown). In order to prevent ions from impacting the first PCB and the second PCB, in various embodiments, the first PCB further includes N−1 metal layers 10 between the N metal layers 100 and the second PCB includes N−1 metal layers 20 between the N metal layers 200. DC voltage source 1320 and the DC circuit apply a DC voltage on each metal layer 10 of the N−1 metal layers of the first PCB and its corresponding metal layer 20 of the N−1 metal layers of the second PCB that varies in voltage according to the DC voltage gradient.

In various embodiments, the system of FIG. 13 further includes an enclosure (not shown). The enclosure encloses the first array of electrodes 100 and the second array of electrodes 200, receives the beam of ions through an ion inlet (not shown), receives a cooling gas through a gas inlet (not shown), and confines the cooling gas under vacuum so that cooling gas cools the ions in uniform gap 1330 sufficiently to prevent the ions from being trapped in quadrupole RF electric fields 4 that do not correspond to the values of the ions.

In various embodiments, the enclosure further includes an inlet wall electrode that includes the ion inlet. The inlet wall electrode is DC biased with respect to the electrodes of the first array and the electrodes of the second array so that the ions are drawn into the enclosure through the ion inlet.

In various embodiments, the system is operated in a flow through mode. For example, the enclosure further includes an outlet wall electrode that includes two or more ion outlets positioned proximate to two or more of the N−1 different quadrupole RF electric fields 4 in the uniform gap 1330. The outlet wall electrode is DC biased with respect to the electrodes of the first array and the electrodes of the second array so that ions sorted in the two or more of the N−1 different quadrupole RF electric fields 4 in the uniform gap 1330 are ejected from the enclosure through the two or more ion outlets.

In various embodiments, the system is operated in an ion trapping mode. For example, the enclosure further includes an outlet wall electrode that includes an ion outlet positioned proximate to a quadrupole RF electric field of the N−1 different quadrupole RF electric fields 4 in the uniform gap that has the highest RF voltage amplitude. The outlet wall electrode is DC biased with respect to the electrodes of the first array 100 and the electrodes of the second array 200 so that ions trapped in the quadrupole RF electric field of the N−1 different quadrupole RF electric fields 4 in the uniform gap that has the highest RF voltage amplitude are ejected from the enclosure through the ion outlet.

In the trapping mode, for example, RF voltage source 1310 is sequentially stepped to lower RF voltage amplitudes to shift ions trapped in the N−1 different quadrupole RF electric fields 4 to adjacent quadrupole RF electric fields and sequentially eject all trapped ions out through the ion outlet. The system further includes a processor (not shown) in communication with RF voltage source 1310, for example. The processor then instructs RF voltage source 1310 to sequentially step to lower RF voltage amplitudes to shift ions trapped in the N−1 different quadrupole RF electric fields 4 to adjacent quadrupole RF electric fields and sequentially eject all trapped ions out through the ion outlet. The processor can be, but is not limited to, a computer, microprocessor, the computer system of FIG. 1, or any device capable of controlling devices, processing data, and sending and receiving data.

In various embodiments, the processor is further in communication with DC voltage source and is used to select the m/z ranges to be sorted. The processor receives m/z ranges from a user. The processor then instructs the RF voltage source to apply the RF voltage and the DC voltage source to superimpose the DC voltage in order to trap the ions in the N−1 different quadrupole RF electric fields according to the m/z ranges.

Method for Sorting Ions by m/z Values

Figure 14:
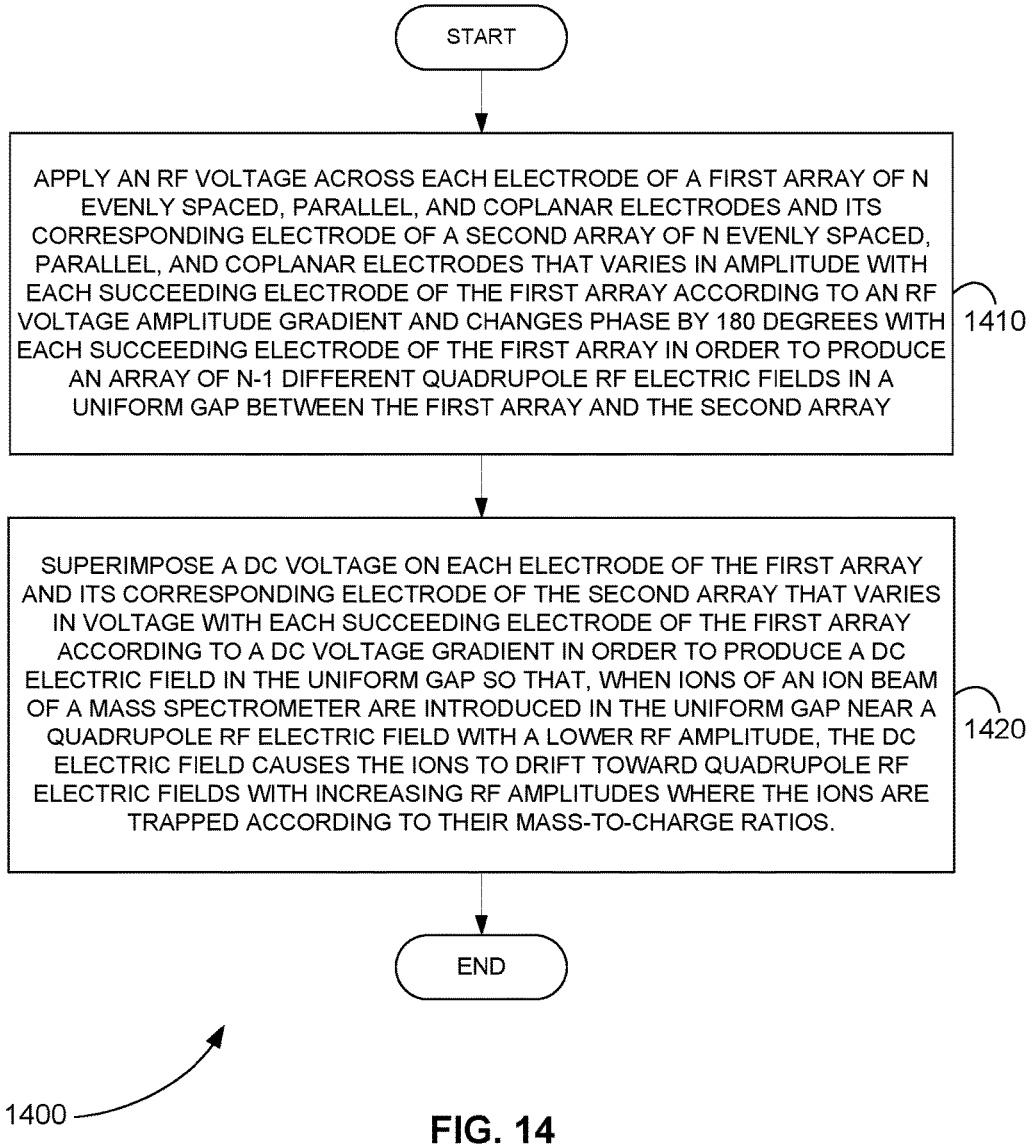
FIG. 14 is a flowchart showing a method for sorting ions by m/z values, in accordance with various embodiments.

FIG. 14 is a flowchart 1400 showing a method for sorting ions by m/z values, in accordance with various embodiments.

In step 1410 of flowchart 1400, an RF voltage is applied across each electrode of a first array of N evenly spaced, parallel, and coplanar electrodes and its corresponding electrode of a second array of N evenly spaced, parallel, and coplanar electrodes. The RF voltage varies in amplitude with each succeeding electrode of the first array according to an RF voltage amplitude gradient. The RF voltage changes phase by 180 degrees with each succeeding electrode of the first array. The RF voltage is applied in order to produce an array of N−1 different quadrupole RF electric fields in a uniform gap between the first array and the second array. The first array and the second array are aligned so that each electrode of the first array is aligned with a corresponding electrode of the second array in a plane that is perpendicular to the plane of the first array.

In step 1420, a DC voltage is superimposed on each electrode of the first array and its corresponding electrode of the second array. The DC voltage varies in voltage with each succeeding electrode of the first array according to a DC voltage gradient in order to produce a DC electric field in the uniform gap. When ions of an ion beam of a mass spectrometer are introduced in the uniform gap near a quadrupole RF electric field with a lower RF voltage amplitude, the DC electric field causes the ions to drift toward quadrupole RF electric fields with increasing RF voltage amplitudes where the ions are trapped according to their m/z values.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for sorting ions by mass-to-charge ratio (m/z) values, comprising:

a first array of N evenly spaced, parallel, and coplanar electrodes;

a second array of N evenly spaced, parallel, and coplanar electrodes aligned with the first array so that there is a uniform gap between the first array and the second array and so that each electrode of the first array is aligned with a corresponding electrode of the second array in a plane that is perpendicular to the plane of the first array, a radio frequency (RF) voltage source and circuit that applies an RF voltage across each electrode of the first array and its corresponding electrode of the second array that varies in amplitude with each succeeding electrode of the first array according to an RF voltage amplitude gradient and changes phase by 180 degrees with each succeeding electrode of the first array in order to produce an array of N−1 different quadrupole RF electric fields in the uniform gap; and a direct current (DC) voltage source and circuit that superimpose a DC voltage on each electrode of the first array and its corresponding electrode of the second array that varies in voltage with each succeeding electrode of the first array according to a DC voltage gradient in order to produce a DC electric field in the uniform gap so that, when ions of an ion beam of a mass spectrometer are introduced in the uniform gap near a quadrupole RF electric field with a lower RF voltage amplitude, the DC electric field causes the ions to drift toward quadrupole RF electric fields with increasing RF voltage amplitudes where the ions are trapped according to their m/z values, wherein the N electrodes of the first array are N metal layers of a first printed circuit board (PCB) and the N electrodes of the second array are N metal layers of a second PCB, and wherein the first PCB further includes N−1 metal layers between the N metal layers and the second PCB includes N−1 metal layers between the N metal layers.

2. The system of claim 1, wherein if the ions are positive ions, the RF voltage amplitude gradient and the DC voltage gradient have opposite directions.

3. The system of claim 1, wherein if the ions are negative ions, the RF voltage amplitude gradient and the DC voltage gradient have the same direction.

4. The system of claim 1, wherein the N electrodes of the first array and the N electrodes of the second array are metal rods.

5. The system of claim 1, wherein the DC voltage source and circuit apply a DC voltage on each metal layer of the N−1 metal layers of the first PCB and its corresponding metal layer of the N−1 metal layers of the second PCB that varies in voltage according to the DC voltage gradient.

6. The system of claim 1, further comprising an enclosure that encloses the first array and the second array, receives the beam of ions through an ion inlet, receives a cooling gas through a gas inlet, and confines the cooling gas under vacuum so that cooling gas cools the ions in the uniform gap sufficiently to prevent the ions from being trapped in a quadrupole RF electric fields that do not correspond to the m/z values of the ions.

7. The system of claim 6, wherein the enclosure further includes an inlet wall electrode that includes the ion inlet and the inlet wall electrode is DC biased with respect to the electrodes of the first array and the electrodes of the second array so that the ions are drawn into the enclosure through the ion inlet.

8. The system of claim 7, wherein the enclosure further includes an outlet wall electrode that includes two or more ion outlets positioned proximate to two or more of the N−1 different quadrupole RF electric fields in the uniform gap and the outlet wall electrode is DC biased with respect to the electrodes of the first array and the electrodes of the second array so that ions trapped in the two or more of the N−1 different quadrupole RF electric fields in the uniform gap are ejected from the enclosure through the two or more ion outlets.

9. The system of claim 7, wherein the enclosure further includes an outlet wall electrode that includes an ion outlet positioned proximate to a quadrupole RF electric field of the N−1 different quadrupole RF electric fields in the uniform gap that has the highest RF voltage amplitude and the outlet wall electrode is DC biased with respect to the electrodes of the first array and the electrodes of the second array so that ions trapped in the quadrupole RF electric field of the N−1 different quadrupole RF electric fields in the uniform gap that has the highest RF voltage amplitude are ejected from the enclosure through the ion outlet.

10. A system for sorting ions by mass-to-charge ratio (m/z) values, comprising:

a first array of N evenly spaced, parallel, and coplanar electrodes;

a second array of N evenly spaced, parallel, and coplanar electrodes aligned with the first array so that there is a uniform gap between the first array and the second array and so that each electrode of the first array is aligned with a corresponding electrode of the second array in a plane that is perpendicular to the plane of the first array, a radio frequency (RF) voltage source and circuit that applies an RF voltage across each electrode of the first array and its corresponding electrode of the second array that varies in amplitude with each succeeding electrode of the first array according to an RF voltage amplitude gradient and changes phase by 180 degrees with each succeeding electrode of the first array in order to produce an array of N−1 different quadrupole RF electric fields in the uniform gap;

a direct current (DC) voltage source and circuit that superimpose a DC voltage on each electrode of the first array and its corresponding electrode of the second array that varies in voltage with each succeeding electrode of the first array according to a DC voltage gradient in order to produce a DC electric field in the uniform gap so that, when ions of an ion beam of a mass spectrometer are introduced in the uniform gap near a quadrupole RF electric field with a lower RF voltage amplitude, the DC electric field causes the ions to drift toward quadrupole RF electric fields with increasing RF voltage amplitudes where the ions are trapped according to their m/z values;

an enclosure that encloses the first array and the second array, receives the beam of ions through an ion inlet, receives a cooling gas through a gas inlet, and confines the cooling gas under vacuum so that cooling gas cools the ions in the uniform gap sufficiently to prevent the ions from being trapped in a quadrupole RF electric fields that do not correspond to the m/z values of the ions, wherein the enclosure further includes an inlet wall electrode that includes the ion inlet and the inlet wall electrode is DC biased with respect to the electrodes of the first array and the electrodes of the second array so that the ions are drawn into the enclosure through the ion inlet, wherein the enclosure further includes an outlet wall electrode that includes an ion outlet positioned proximate to a quadrupole RF electric field of the N−1 different quadrupole RF electric fields in the uniform gap that has the highest RF voltage amplitude and the outlet wall electrode is DC biased with respect to the electrodes of the first array and the electrodes of the second array so that ions trapped in the quadrupole RF electric field of the N−1 different quadrupole RF electric fields in the uniform gap that has the highest RF voltage amplitude are ejected from the enclosure through the ion outlet, wherein the RF voltage source is sequentially stepped to lower RF voltage amplitudes to shift ions trapped in the N−1 different quadrupole RF electric fields to adjacent quadrupole RF electric fields and sequentially eject all trapped ions out through the ion outlet.

11. The system of claim 10, further comprising a processor in communication with the RF voltage source that instructs the RF voltage source to sequentially step to lower RF voltage amplitudes to shift ions trapped in the N−1 different quadrupole RF electric fields to adjacent quadrupole RF electric fields and sequentially eject all trapped ions out through the ion outlet.

12. The system of claim 1, further comprising a processor in communication with the RF voltage source and the DC voltage source that receives m/z ranges from a user and instructs the RF voltage source to apply the RF voltage and the DC voltage source to superimpose the DC voltage in order to trap the ions in the N−1 different quadrupole RF electric fields according to the m/z ranges.

13. A method for sorting ions by mass-to-charge ratio (m/z) values, comprising:

applying an radio frequency (RF) voltage across each electrode of a first array of N evenly spaced, parallel, and coplanar electrodes and its corresponding electrode of a second array of N evenly spaced, parallel, and coplanar electrodes that varies in amplitude with each succeeding electrode of the first array according to an RF voltage amplitude gradient and changes phase by 180 degrees with each succeeding electrode of the first array in order to produce an array of N−1 different quadrupole RF electric fields in a uniform gap between the first array and the second array, wherein the first array and the second array are aligned so that each electrode of the first array is aligned with a corresponding electrode of the second array in a plane that is perpendicular to the plane of the first array; and superimposing a direct current (DC) voltage on each electrode of the first array and its corresponding electrode of the second array that varies in voltage with each succeeding electrode of the first array according to a DC voltage gradient in order to produce a DC electric field in the uniform gap so that, when ions of an ion beam of a mass spectrometer are introduced in the uniform gap near a quadrupole RF electric field with a lower RF voltage amplitude, the DC electric field causes the ions to drift toward quadrupole RF electric fields with increasing RF voltage amplitudes where the ions are trapped according to their m/z values, wherein the N electrodes of the first array are N metal layers of a first printed circuit board (PCB) and the N electrodes of the second array are N metal layers of a second PCB, and wherein the first PCB further includes N−1 metal layers between the N metal layers and the second PCB includes N−1 metal layers between the N metal layers.

* * * * *